US005404595A

United States Patent [19]

Carmel

[11] Patent Number: 5,404,595

[45] Date of Patent: Apr. 11, 1995

[54] DEVICE FOR RAISING A TOILET SEAT

[76] Inventor: Yehuda Carmel, P.O. Box 791, Kiron 55000, Israel

[21] Appl. No.: 156,835

[22] Filed: Nov. 24, 1993

[30] Foreign Application Priority Data

Nov. 24, 1992 [IL] Israel ..... 104228
Nov. 25, 1992 [IL] Israel ..... 103869

[51] Int. Cl.[6] ..... A47K 13/10
[52] U.S. Cl. ..... 4/246.1; 4/246.3
[58] Field of Search ..... 4/246.3, 246.4, 246.5, 4/246.1, 248

[56] References Cited

U.S. PATENT DOCUMENTS

| | | | |
|---|---|---|---|
| 621,790 | 3/1899 | Burger et al. | 4/246.3 |
| 1,863,682 | 6/1932 | Albberts | 4/246.3 |
| 2,155,548 | 4/1939 | Hompesch | 4/246.3 |
| 2,705,330 | 4/1955 | Knudsen | 4/246.1 |
| 2,776,440 | 1/1957 | Miller | 4/246.3 |
| 2,954,565 | 10/1960 | Miller | 4/246.3 |
| 3,417,411 | 12/1968 | Greenwood | 4/246.3 |
| 4,150,446 | 4/1979 | Crocker | 4/246.3 |
| 4,470,161 | 9/1984 | Seabrooke | 4/246.3 |
| 4,592,097 | 6/1986 | Zimmerman | 4/246.4 |
| 5,103,506 | 4/1992 | Munford et al. | 4/246.4 |
| 5,323,496 | 6/1994 | Blais | 4/246.3 |

FOREIGN PATENT DOCUMENTS

| | | | |
|---|---|---|---|
| 1377147 | 9/1964 | France | 4/246.4 |

*Primary Examiner*—Henry J. Recla
*Assistant Examiner*—Charles R. Eloshway
*Attorney, Agent, or Firm*—Popham, Haik, Schnobrich & Kaufman, Ltd.

[57] ABSTRACT

The present invention relates to a device for the purpose of raising a toilet seat without touching it, which comprises actuating means being connected to power transferring means, which are in turn connected to the toilet seat.

The actuating means may be an electric magnet or an electric motor, either being connected to an electric source, and advantageously actuated by a switch. They may also be a pedal being connected to a rod or other pneumatic or hydraulic means.

The power transferring means may be, for example, a frame open in one direction, or a lever being connected to, or a part of, the toilet seat. Said means are suitably connected to a rotatable axis on which the toilet seat is located.

2 Claims, 2 Drawing Sheets

DEVICE FOR RAISING A TOILET SEAT

The present invention relates to a device for the purpose of raising a toilet seat without touching same.

In many instances it is desirable that if men are using the toilet facilities they should not have to touch the toilet seat. However, no such means are so far known. It has thus been desirable to design a device for such purposes, which device should be simple, cheap to manufacture and preferably attachable to the toilet seat presently being used commercially.

The present invention thus consists in a device for raising a toilet seat, said device comprising suitable actuating means being connected by suitable means to power transferring means, said power transferring means being connected to the toilet seat, which axis may be a separate part or an integral part of the toilet seat.

The actuating means may be, for example, an electromagnet or an electric motor, either being connected to an electric source and advantageously actuated by a switch. The electric source may be the general electric net, a battery, etc. Said actuating means may also be suitable pneumatic or hydraulic means. They might also be a pedal being connected to a rod. A rod means a rod proper, a tube, a hose, etc.

The means by which actuating means are connected to the power transferring means are, for example, movable on an axis.

The power transferring means are, for example, a frame open in one direction, a lever, etc. Said means are suitably connected to a rotatable axis on which the toilet seat is located.

The device according to the present invention operates as follows:

The user of the toilet facilities, by operating the actuating means to operate the power transferring means, causes the toilet seat to be raised. The moment the operating means are no longer operated, the seat is lowered to its original position. If desired, the lid of the toilet may also be connected to said rotatable axis, if present, or to any other suitable means, and will thus be raised or lowered together with the toilet seat.

The various parts of the device according to the present invention may be made from any suitable material; advantageously all parts are made from the plastic material from which the toilet seat is manufactured. However, it is readily understood that the device is not restricted to said material and may be made also from, e.g. wood, metal, rubber, etc.

The present invention will now be illustrated with reference to the accompanying drawings without being limited by them. Identical parts will be referenced in all drawings with the same number. In said drawings.

Figure 1:
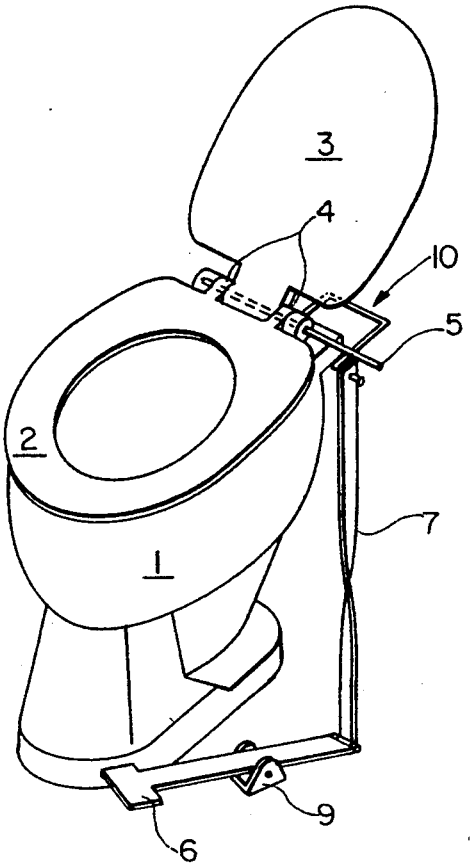
FIG. 1 shows an isometric view of a device according to the present invention attached to the toilet seat.
Figure 2:
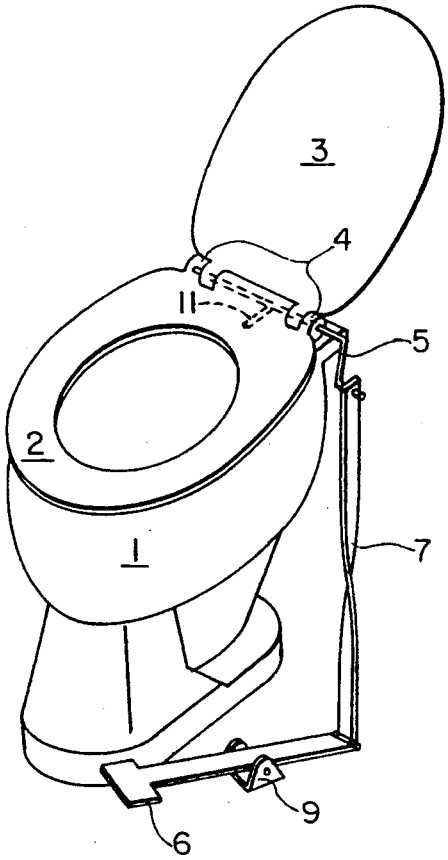
FIG. 2 shows an isometric view of another embodiment of a device according to the present invention attached to the toilet seat.
Figure 3:
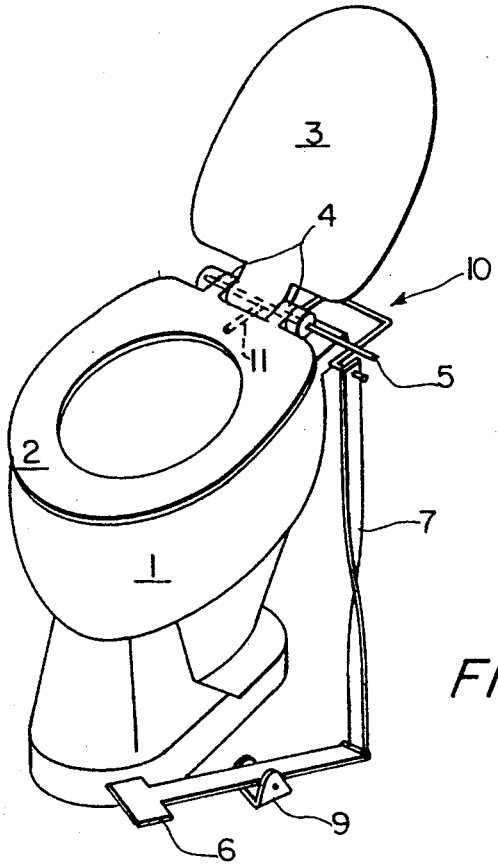
FIG. 3 shows an isometric view of still a further embodiment of a device according to the present invention attached to the toilet seat.

The toilet facility shown in the various embodiments illustrated in FIGS. 1 to 3 comprises bowl 1, seat 2 and lid 3. There are two bases 4, connected to seat 2 rotatable around axis 5.

The device shown in said FIGS. 1 to 3 comprises pedal 6 connected to rod 7 movable around base 9. Rod 7 is connected to the power transferring means being in FIG. 1 open frame 10, in FIG. 2 lever 11, and in FIG. 3 a combination of frame 10 and lever 11.

Figure 4:
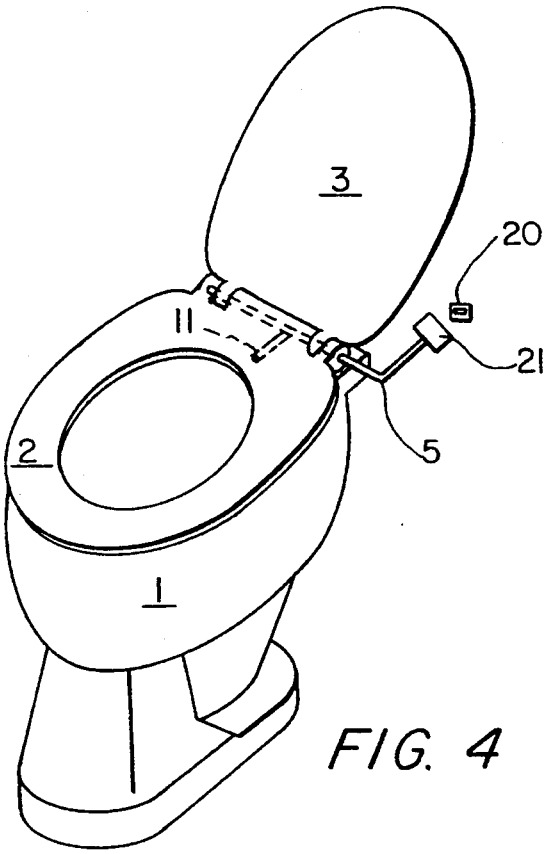
FIG. 4 shows an isometric view of a further embodiment of a device according to the present invention attached to the toilet seat.

The device illustrated in FIG. 4 comprises as actuating means electro-magnet 20, opposite to which is located plate 21 made from a ferro-magnetic material. Said plate 21 is connected by rod 22 via axis 5 to lever 11. Magnet 20 is connected via a switch to an electric source (both not shown). The moment the switch is "on", plate 21 is drawn towards the magnet 20 and lever 11 raises toilet seat 2 upwards. The moment the switch is "off", plate 21 returns to its original position and thus seat 2 is located again on bowl 1.

Figure 5:
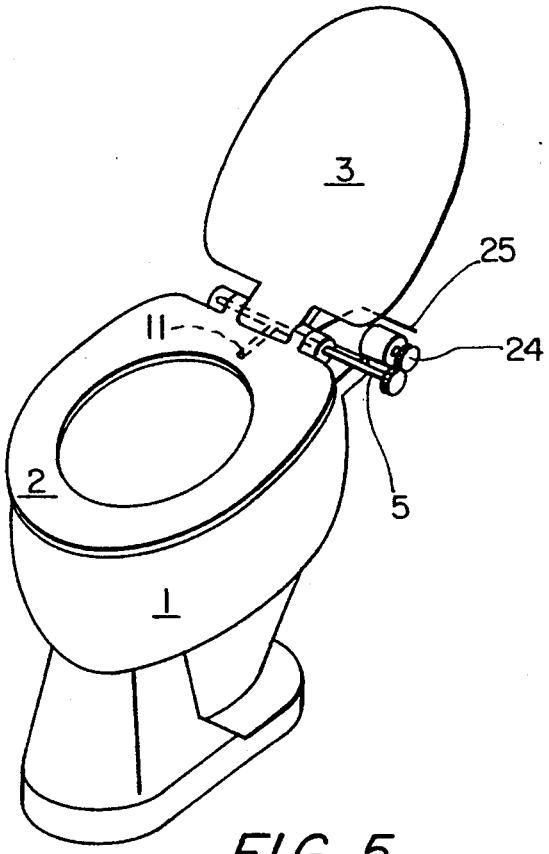
FIG. 5 shows an isometric view of still another embodiment of a device according to the present invention attached to a toilet seat.

The device illustrated in FIG. 5 comprises as actuating means electric motor 24 covered by cover 25. Said engine is connected via a switch to an electric source (both not shown). The moment the switch is "on", axis 5 is caused to rotate causing lever 11 to raise seat 2. The moment the switch is "off" the above action is reversed and the toilet seat returns to its original position.

I claim:

1. A device for raising a toilet seat hinged to a toilet bowl, the toilet seat having a rearward portion and left and right spaced bases projecting from the rearward portion, the toilet seat being rotatable about an axis through the left and right bases, said device comprising:

an elongated shaft adapted to form the axis for the bases projecting from the rearward portion of the toilet seat and to attach the left and right bases to the toilet bowl, said shaft having a first end and a second end;

a lever extending forwardly from said shaft, said lever being adapted for insertion under the toilet seat intermediate the left and right bases; and a pivot base adapted for attachment to a floor;

a substantially vertical rod having an upper end and a lower end, said upper end being pivotally connected to said second end of said shaft; and, an elongated substantially horizontal pedal, said pedal having a forward end and a rearward end, said forward end being enlarged to define a foot-engaging portion, said rearward end being connected to said lower end of said rod, said pedal together with said rod defining an L-shape, and said pedal being pivoted on said pivot base intermediate said forward and rearward ends; and, wherein said shaft has a first straight portion adapted to extend between the left and right bases of said toilet seat, and a second portion extending from said first straight portion, exteriorly of one of said left and right bases, said second end of said shaft forming an end of said second portion.

2. A toilet seat assembly comprising:

a toilet seat adapted to be hinged to a toilet bowl, said toilet seat having a rearward portion, left and right spaced bases projecting from said rearward portion, and upper and lower surfaces, said toilet seat being rotatable about an axis through said spaced bases;

an elongated shaft defining said axis for said bases projecting from said rearward portion of said toilet seat, said shaft being adapted to attach said left and right bases to the toilet bowl, and said shaft having a first end and a second end;

a lever extending forwardly from said shaft, said lever being positioned against said lower surface of said toilet seat intermediate said left and right bases; and a pivot base adapted for attachment to a floor;

a substantially vertical rod having an upper end and a lower end, said upper end being pivotally connected to said second end of said shaft; and, an elongated substantially horizontal pedal, said pedal having a forward end and a rearward end, said forward end being enlarged to define a foot-engaging portion, said rearward end being connected to said lower end of said rod, said pedal together with said rod defining an L-shape, and said pedal being pivoted on said pivot base intermediate said forward and rearward ends; and, wherein said shaft has a first straight portion adapted to extend between the left and right bases of said toilet seat, and a second portion extending from said first straight portion, exteriorly of one of said left and right bases, said second end of said shaft forming an end of said second portion.

* * * * *